US006044895A

United States Patent [19]

Kuttner et al.

[11] Patent Number: 6,044,895

[45] Date of Patent: Apr. 4, 2000

[54] CONTINUOUS CASTING AND ROLLING SYSTEM INCLUDING CONTROL SYSTEM

[75] Inventors: Werner Kuttner, Moehrendorf; Friedemann Schmid; Hannes Schulze Horn, both of Erlangen; Kurt Hohendahl, Osnabrück; Thomas Berger; Immo Domnig, both of Uttenreuth, all of Germany

[73] Assignee: Siemens Aktiengesellschaft, Munich, Germany

[21] Appl. No.: 08/647,949

[22] PCT Filed: Dec. 21, 1993

[86] PCT No.: PCT/DE93/01228

§ 371 Date: Mar. 6, 1997

§ 102(e) Date: Mar. 6, 1997

[87] PCT Pub. No.: WO95/15233

PCT Pub. Date: Jun. 8, 1995

[51] Int. Cl.[7] ..... B22D 11/06; B22D 11/12; B22D 11/16

[52] U.S. Cl. ..... 164/155.4; 164/154.4; 164/154.5; 164/154.7; 164/155.6; 164/413; 164/414; 164/417; 164/428; 164/449.1

[58] Field of Search ..... 164/154.4, 154.5, 164/154.7, 155.4, 155.6, 449.1, 450.1, 450.2, 450.3, 450.4, 450.5, 413, 414, 417, 428, 452, 453, 454, 455, 476, 480

[56] References Cited

U.S. PATENT DOCUMENTS

| | | | |
|---|---|---|---|
| 3,358,743 | 12/1967 | Adams | 164/413 X |
| 4,951,734 | 8/1990 | Hoffken et al. . | |
| 5,052,467 | 10/1991 | Tanaka et al. | 164/428 X |
| 5,058,656 | 10/1991 | Hoffken et al. . | |

FOREIGN PATENT DOCUMENTS

| | | | |
|---|---|---|---|
| 0 228 038 | 7/1987 | European Pat. Off. . | |
| 0 326 190 | 8/1989 | European Pat. Off. . | |
| 0 384 151 | 8/1990 | European Pat. Off. . | |
| 0 391 823 | 10/1990 | European Pat. Off. . | |
| 0 458 987 | 12/1991 | European Pat. Off. . | |
| 0 481 481 | 4/1992 | European Pat. Off. . | |
| 3 624 114 | 1/1988 | Germany . | |
| 3 712 537 | 11/1988 | Germany . | |
| 60-15053 | 1/1985 | Japan | 164/480 |
| 61-206506 | 9/1986 | Japan | 164/476 |
| 4-170920 | 6/1992 | Japan . | |

*Primary Examiner*—J. Reed Batten, Jr.
*Attorney, Agent, or Firm*—Kenyon & Kenyon

[57] ABSTRACT

A continuous casting and rolling system for steel strips includes a vertically working two-roll casting device, a first device for adding molten steel to the casting device, a second device for guiding a cast strip produced by the casting device into a horizontal position, a horizontally working rolling mill for working the cast strip, and a reel device receiving the strip worked in the horizontally working rolling mill. Each of the casting device, the first device, the second device, the horizontally working rolling mill and the reel device are controlled by respective individual closed-loop control systems. The system also includes a central control system connected to the first device, the casting device, the second device, the rolling mill and the reel device for an integrated adjustment of the respective individual closed-loop control systems as a function of mathematical models. Each of the first device, the casting device, the second device, the rolling mill and the reel device is an individual component of the continuous casting and rolling system. The central control system automatically controls the individual components with respect to their interaction to produce a strip which is suitable for further processing to allow for effects control steps of one of the individual components on downstream components of the system.

15 Claims, 7 Drawing Sheets

CONTINUOUS CASTING AND ROLLING SYSTEM INCLUDING CONTROL SYSTEM

FIELD OF THE INVENTION

This invention concerns a continuous casting and rolling system for steel strips and a corresponding control system.

BACKGROUND OF THE INVENTION

Since the very first continuous casting and rolling system as described in German patent 52,002, many different designs of such casting and rolling systems have been developed. What these developments have in common is that so far they have been successful only for low-alloy steel, when the casting system produces a so-called thin slab at least 50 mm thick (German patent 3712537), which is then fed to the first roller or cast as strips in the case of stainless steel as described in European patents 0458987 and 0481481.

OBJECT AND SUMMARY OF THE INVENTION

The object of this invention is to provide a continuous casting and rolling system and a control system that will allow production of steel strips of any grade within processing tolerances, assuming the cast strips are 5 to 20 mm thick.

This object is achieved with an optimized design of individual parts of the system with respect to their interaction to produce steel strips suitable for further processing and by coordinating the operations. Such coordination is preferably optimized by a neuro-fuzzy system.

DETAILED DESCRIPTION

Figure 1:
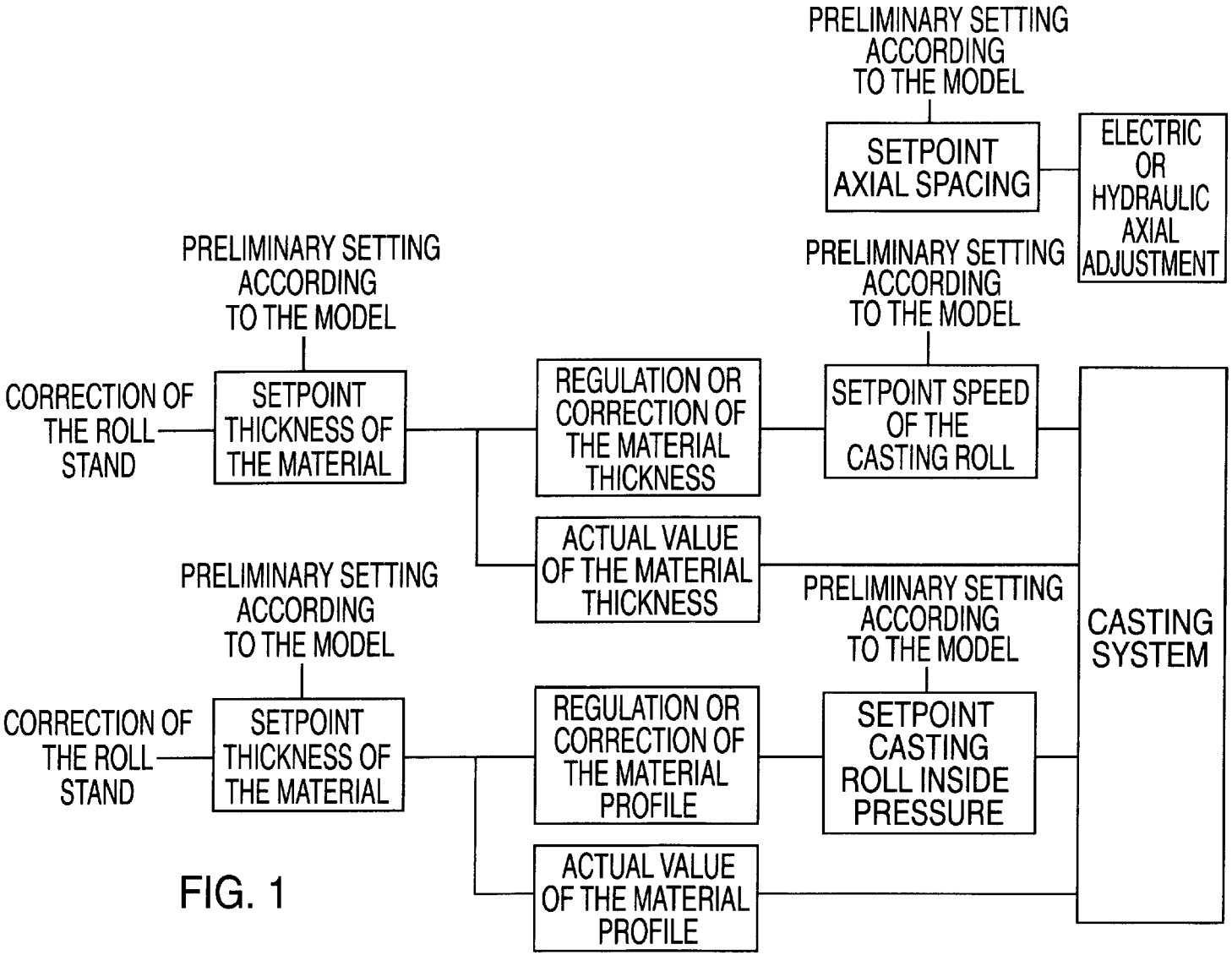
FIG. 1 is a block diagram of a control system in accordance with the invention.
Figure 2:
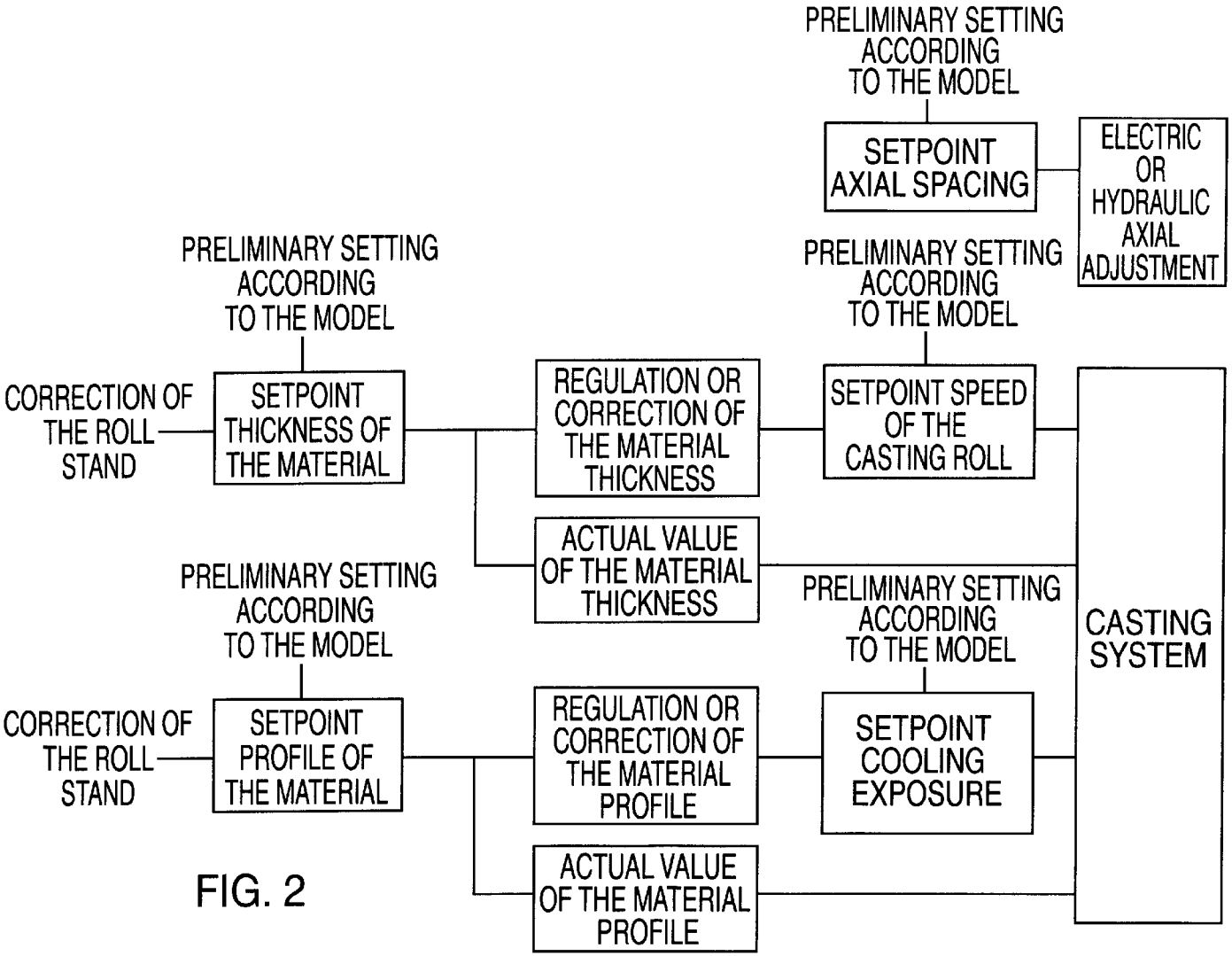
FIG. 2 is a block diagram of another control system in accordance with the invention.
Figure 3:
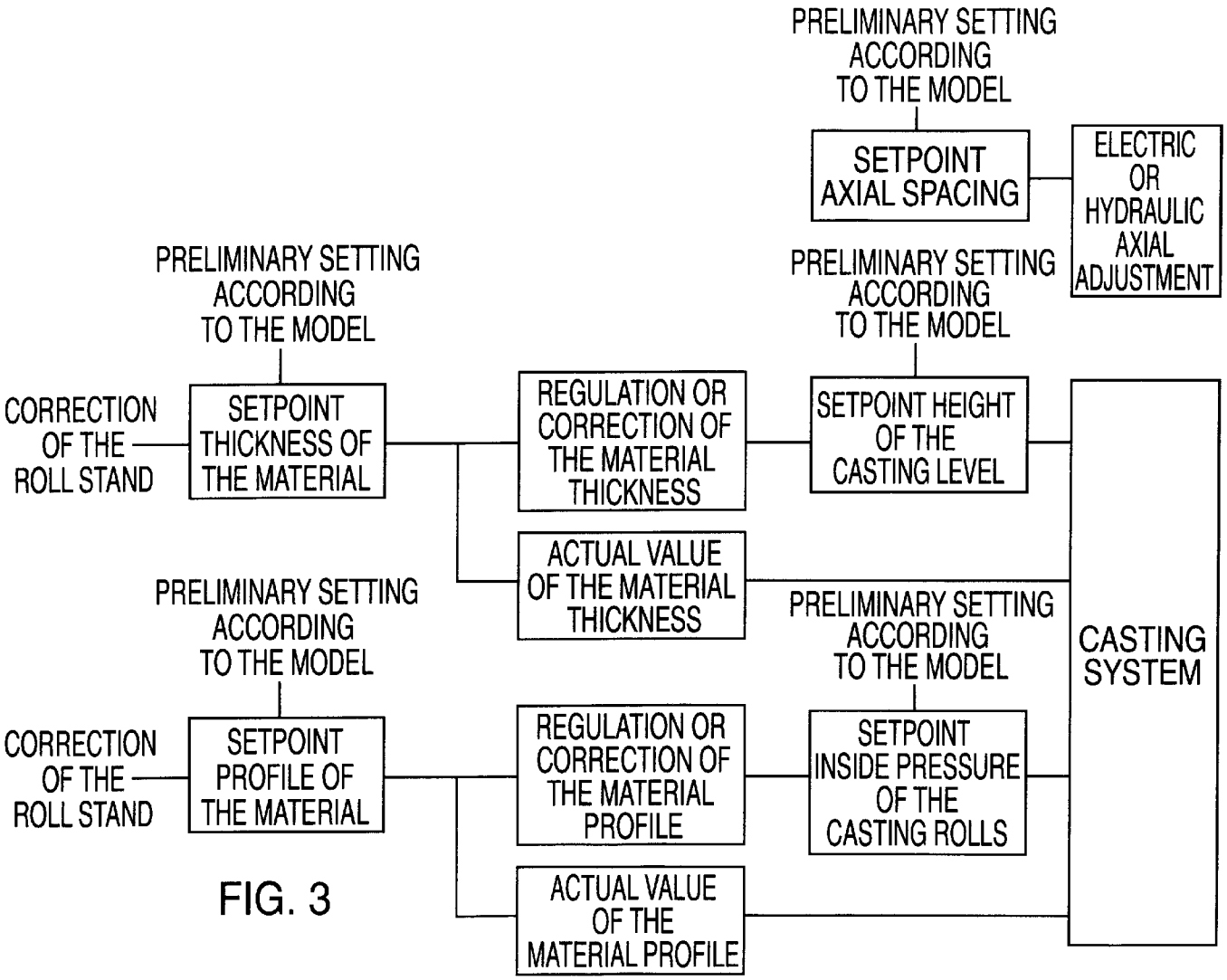
FIG. 3 is a block diagram of another control system in accordance with the invention.
Figure 4:
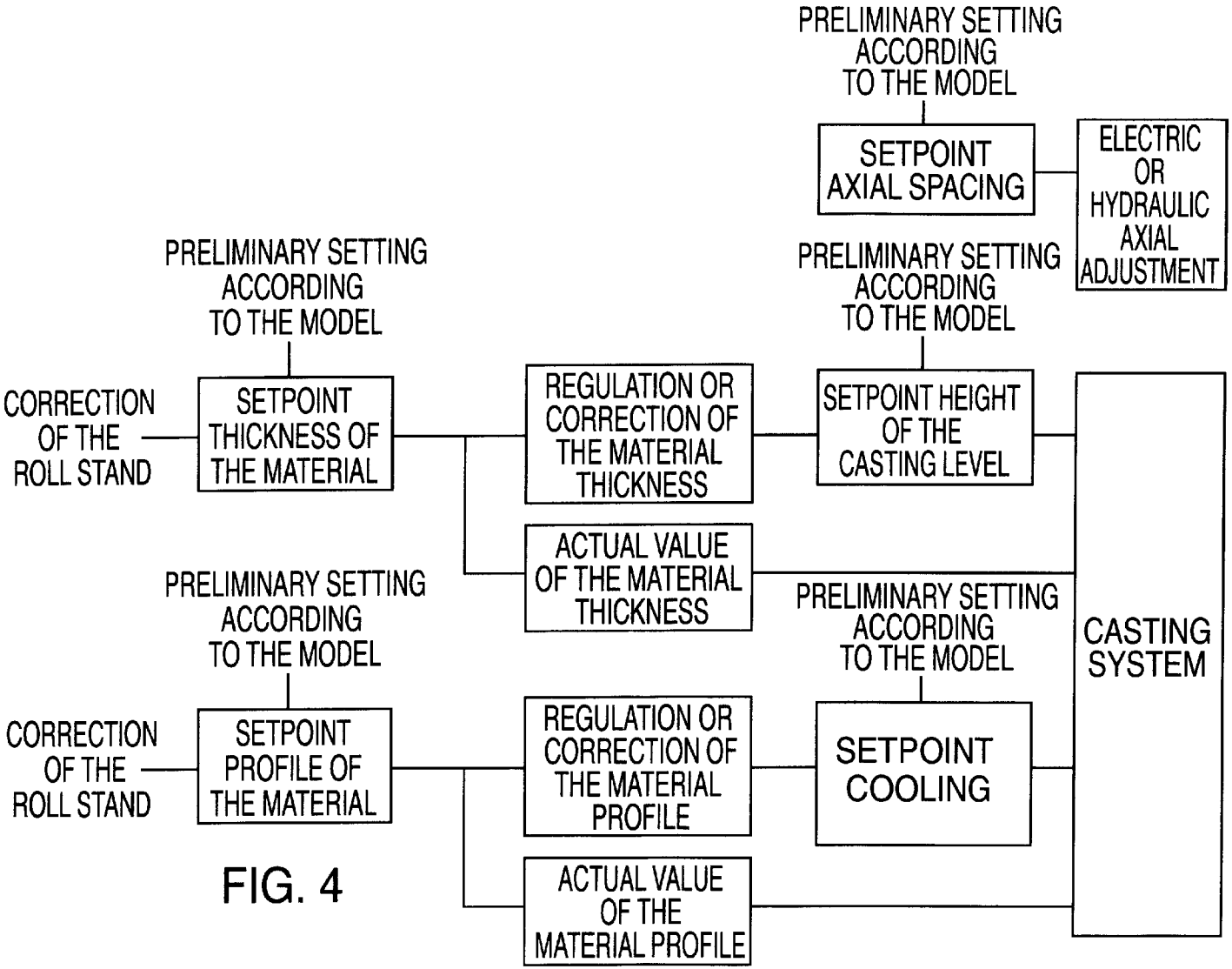
FIG. 4 is a block diagram of another control system in accordance with the invention.

Advantageous details concerning the individual parts of the system and the control system are given in the following description.

Starting with a pouring stream discharged from a tundish or a fore-hearth, a hot-rolled strip approximately 2 to 4 mm thick is to be produced by rolling directly from the molten condition and subsequent forming. In individual cases, a thickness of 1 mm should be feasible. Continuous casting and rolling systems with the following basic electrotechnical components, some of which are already known, are used for this purpose.

Slide valve drive is provided with a regulation of the pouring stream on the tundish or fore-hearth. The pouring stream enters a precooling system, optionally an inlet mold, where the casting level is set with an accuracy of ±3 mm by means of a radiometric measurement such as that performed with an instrument manufactured by Dr. Berthold, for example. This setting does not depend on the cross section of the distribution and/or precooling system, which may be designed as a chamber or may be open at the top.

Coolant regulation and optionally a stirring device in the form of an electric coil are provided for the distribution and precooling systems, which can especially be designed as an inlet mold for thick cross sections, but it may also be designed as a distributor trough or as a box attachment with a cover. When designed as an inlet mold, it is advantageous for the design to be controllable, as described in German patent 4,030,683 A1.

The pair of casting rolls preferably have coolant regulation and also power regulation and position control and especially calculation of the instantaneous form. The shape of the casting and rolls is based on the requirements of the downstream rolling equipment, so as to yield a steel strip that conforms to the required tolerance with a minimum of adjustment. A rectangular outlet profile, especially with crowned edges, has proven to be especially suitable.

Downstream from the casting rolls, there will preferably be an electromagnetic strip control and appropriate strip guidance devices that at least partially replace the rolls customary in the past, which can lead to surface defects, especially in continuous operation, or promote the development of edge cracks. In addition, inductive strip temperature distribution and regulating equipment is also provided in this area, and a pressurized water descaling system is also provided directly upstream from the first forming roll. The casting rate is preferably set at approx. 6 to 10 m/min. Single-part or multi-part line inductors are used to regulate the edge temperature, and plate inductors that can be switched on and off individually are provided to make the temperature uniform, if necessary. These measures even make it possible to adjust the inlet temperature of the cast strip into the first roll stand with a given temperature profile over the width. Like the casting temperature, the inlet temperature of the strip into the forming rolls is adjusted essentially according to the alloy, in other words, the grade of steel, and the final dimensions to be achieved in rolling, namely the degree of forming by the rolls.

Simple two-high or four-high stands having at least a roll gap adjustment and a roll bending device are provided. If possible, the nominal profile and cross section, which is also influenced by the reel tension, are adjusted here on the basis of the strip profile actually cast.

A heat treatment zone containing inductive equipment and optionally also cooling systems may be provided downstream from the last roll stand when the system includes one to three roll stands, depending on the degree of forming needed to achieve the final cross section. Cycle annealing, for example, is used here to influence the grain. In addition, a temperature holding zone may be provided upstream from the reel. This yields a controlled heat treatment starting from the rolling heat.

Downstream from the rolls, there are preferably thickness and profile measurement devices to monitor the roll settings, roll bending and the pull-out force from the rolls to produce a strip that conforms to the required tolerances. The profile entering the rolls is advantageously determined by computation, and the computations can be verified through measurements. The computations may be based on the alloy solidification data, the calculated instantaneous form of the casting rolls and optionally also the strip temperature profile across the width.

The inductive equipment and the casting equipment (including cooling) are preferably controlled and regulated by an automation system based on Siemens "SIMATIC S5" whereas the casting rolls, the forming rolls and the reel preferably have a control and regulation system based on Siemens "Symadin D." The automation equipment is preferably linked by a bus system and connected to a control unit. The finished rolled strip has profile deviations below the cold roll inlet tolerance of approx. max. ±0.025 mm for a 4 mm strip.

The individual automation and measurement devices are organized especially in automation groups based on the technology and they are linked together by a feed-forward-feedback control system. In an especially preferred embodiment, the control system has an empirical value matrix with an influence logic circuit in the basic form of a self-optimizing neural network with fuzzy input data and automatically generated expert knowledge. This yields a higher-level control system that can link together individual units with a relatively simple design in an inexpensive embodiment to produce a crack-free strip with tolerances within the control limits of a downstream cold-rolling mill and in doing so automatically brings together the empirical results regarding how the individual units will perform with different input values and procedures.

In additional special embodiments of this invention, the tundish or fore-hearth output control into a pouring spout and channel, etc., is regulated by means of slides with an electric drive as a function of the inlet casting level and given requirements, such as the thickness of the strip. The inlet casting level or the level above the casting rolls can be determined not only by radiometric measurements but also by optical measurements or float measurements.

If coolant regulation of the inlet area is needed, it is based on wall thermocouples or the data from the tundish outlet control in conjunction with a measurement of the output flow rate. Here again, a matrix of empirical values is used, taking into account the alloy influences, for example.

The casting rolls have speed and torque control, and the instantaneous forming energy required is determined in a very advantageous manner by cyclic release of the speed and torque control. The greater the forming energy required instantaneously, the higher will be the combining zone of the two solidification shells formed on the casting rolls above the connecting plane of the casting roll center lines and vice versa. The forming energy required instantaneously is thus a good control parameter. This makes it possible to avoid a breakthrough to the discharge side to great advantage as well as an excessively high position of the solidification shell combining zone. Misalignment of the combining zone toward one side can be compensated by selective cooling. German patent 4,021,197 A1 discloses details regarding unilateral misalignment of the combining zone. Such misalignment of the combining zone can be detected, for example, on the basis of the discharge temperature profile. The casting rolls are controlled with reference to their axial position (spacing, offset). Their actual shape and position can be determined by means of continuous IR-laser measurements, for example, and corrected if necessary. The amount of coolant is adjusted in particular according to information on the inlet area and the speed of the casting roll. Minor corrections in crowning are possible by means of electric devices such as induction heating.

The discharge of the cast strip is regulated by taking into account the low maximum tensile stress on the outlet side of the casting rolls. This regulation can be regarded either in conjunction with the regulation of the roll stands or as regulation of a separate roll stand with electromagnetic regulation of tension. Regulation is optimally based on a constant maximum melt flow, depending on the maximum cooling power, with adjustment of the roll speed to the speed of the casting roll.

Downstream from the outlet from the casting rolls, there is preferably a device for monitoring the temperature and shape of the edge of the strip. The shape and temperature of the edge of the strip can be controlled by regulating the cooling and adjusting the side elements on the casting rolls. The side elements of the casting rolls are preferably arranged on the circumference of the casting rolls and they preferably work in conjunction with inductive heating or a cooling system and a position control system based on a matrix of empirical values, for example.

The surfaces of the casting rolls preferably have a structural pattern, where a fishbone or zigzag pattern is especially advantageous. Structural depressions can be cleaned by spraying with water in combination with a brush system, for example, where it is advantageous to monitor the cleaning with a laser, which may optionally also make any corrections required.

For satisfactory separation of the strip from the casting rolls, it is advantageous to provide an electromagnetic strip vibrating system, for example, which is supplemented as needed by a platform and casting roll vibrating system which may also be electromagnetic. An imaging and pattern recognition unit, such as a system using infrared cameras to monitor the surface quality of the strip is preferably provided between the casting rolls and the first forming stand. Assuming that visible scale cracks exceeding a maximum length and likewise scale cracks at the edges on both sides are a sign of surface cracks (deviation from a normal crack pattern), the behavior of the electromagnetic equipment is influenced accordingly, and optionally a repair of the cracks may be performed by partial inductive heating. Defects are corrected through controlled electric measures, supported by position control and/or heating and cooling regulation of the edge forming control elements in the case of edge cracks. This results in entry of the strip which is free of macroscopically visible cracks into the first forming stand, where microcracks and intercrystalline separations are unavoidably welded. Upstream from the roll stands there may optionally be a profile and thickness measuring device which especially performs a trend analysis of the profile and thickness. This information is used especially for the neuro-fuzzy system with its if-then rules, but it can also be analyzed by differentiation in the conventional way. The same thing is also true of the other trends that are considered.

Downstream from the rolls there is preferably an inductive heat treatment with a given temperature profile, such as a cycle annealing treatment at temperatures around 720° C. and/or subsequent holding at 500° C. to 550° C. in the case of alloyed steel.

The downstream reel has a tension control to achieve the predetermined final thickness of the strip on the last roll stand while maintaining a minimum and maximum tension.

The higher-level control system which essentially also functions on the basis of mathematical models with adaptation on a neuro-fuzzy basis (mostly with training of the network) serves especially to coordinate the profile produced in the casting roll and the condition of the strip with the downstream units. This makes it possible to operate the casting rolls as well as the forming rolls to advantage without expensive displacement equipment (forming rolls) or equipment to change the crowning (casting rolls). Using this matrix of empirical values, an optimum reaction to the prevailing conditions can be achieved relatively rapidly for the different feed conditions to the casting rolls whose behavior in operation can be determined by simulation and/or experimentation as part of the startup operation and for the feed conditions to the roll stand. Depending on the alloy and the inlet conditions, especially the inlet temperature, strips that conform to the required tolerances can be produced with very simple equipment after a relatively short time, taking into account the available cooling power. As a rule, estimated values for the fuzzy set parameters that are improved with the help of the self-learning neural network are sufficient for the matrix of empirical values. The respective fuzzy rules for processing the fuzzy sets are verified as part of trial operation after prior simulation of effect (especially with regard to critical states) and also become part of the empirical value matrix, where the neural network changes the weighing of the fuzzy rules in accordance with requirements.

Under the central control system with an especially advantageous neural network with a fuzzy structure and a matrix of empirical values for preliminary control or direct control, arranged control structures, some of them according to this invention, are derived from captioned FIGS. 1 to 4. The principles of some important fuzzy rules are apparent from the accompanying table and some important design details according to this invention as well as a survey of the control system according to this invention are shown in FIGS. 5 to 7.

Figure 5:
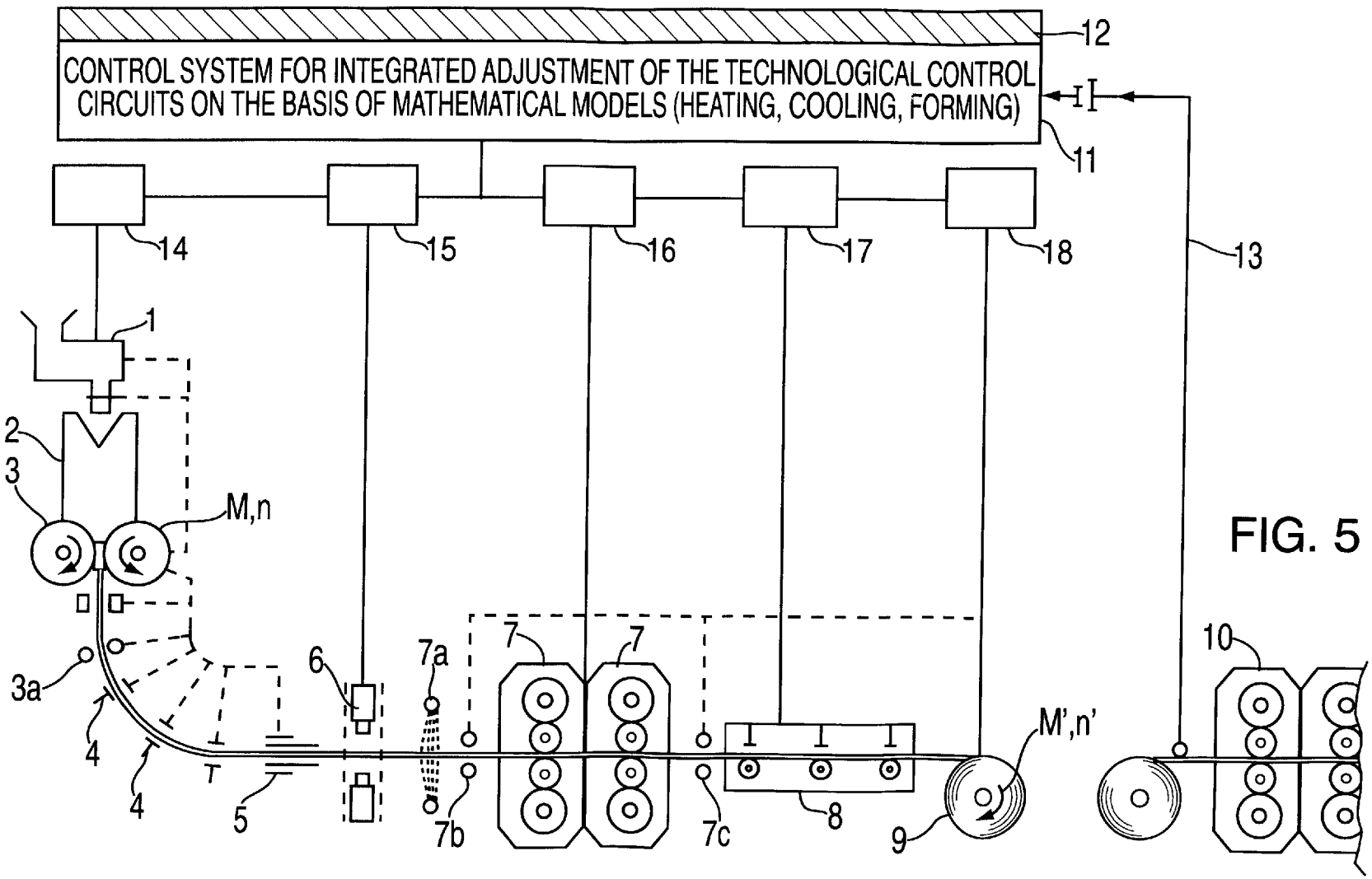
FIG. 5 is a schematic view of a rolling and casting system in accordance with the invention.
Figure 6:
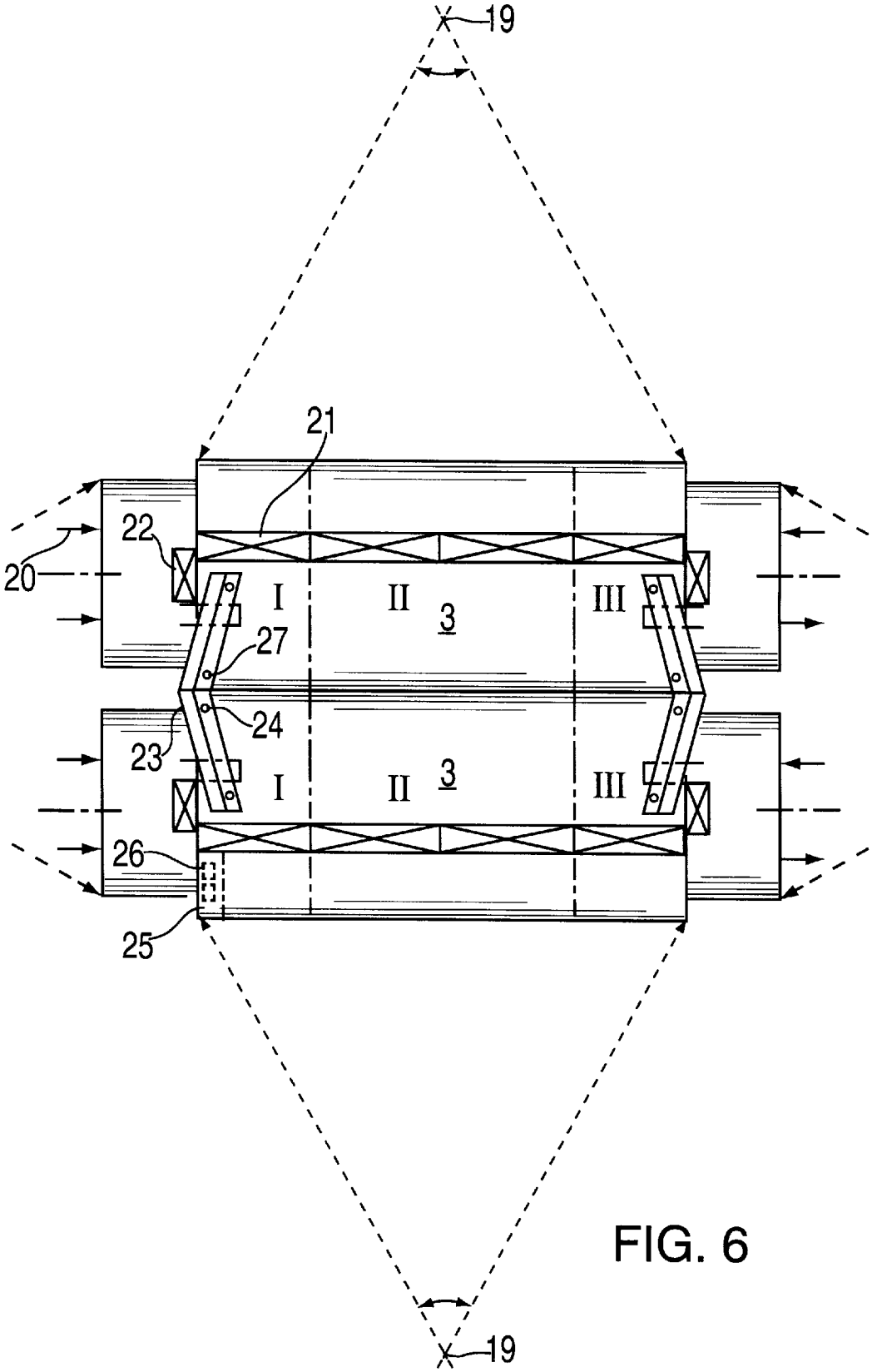
FIG. 6 is a view of the casting rolls in accordance with the invention.
Figure 7:
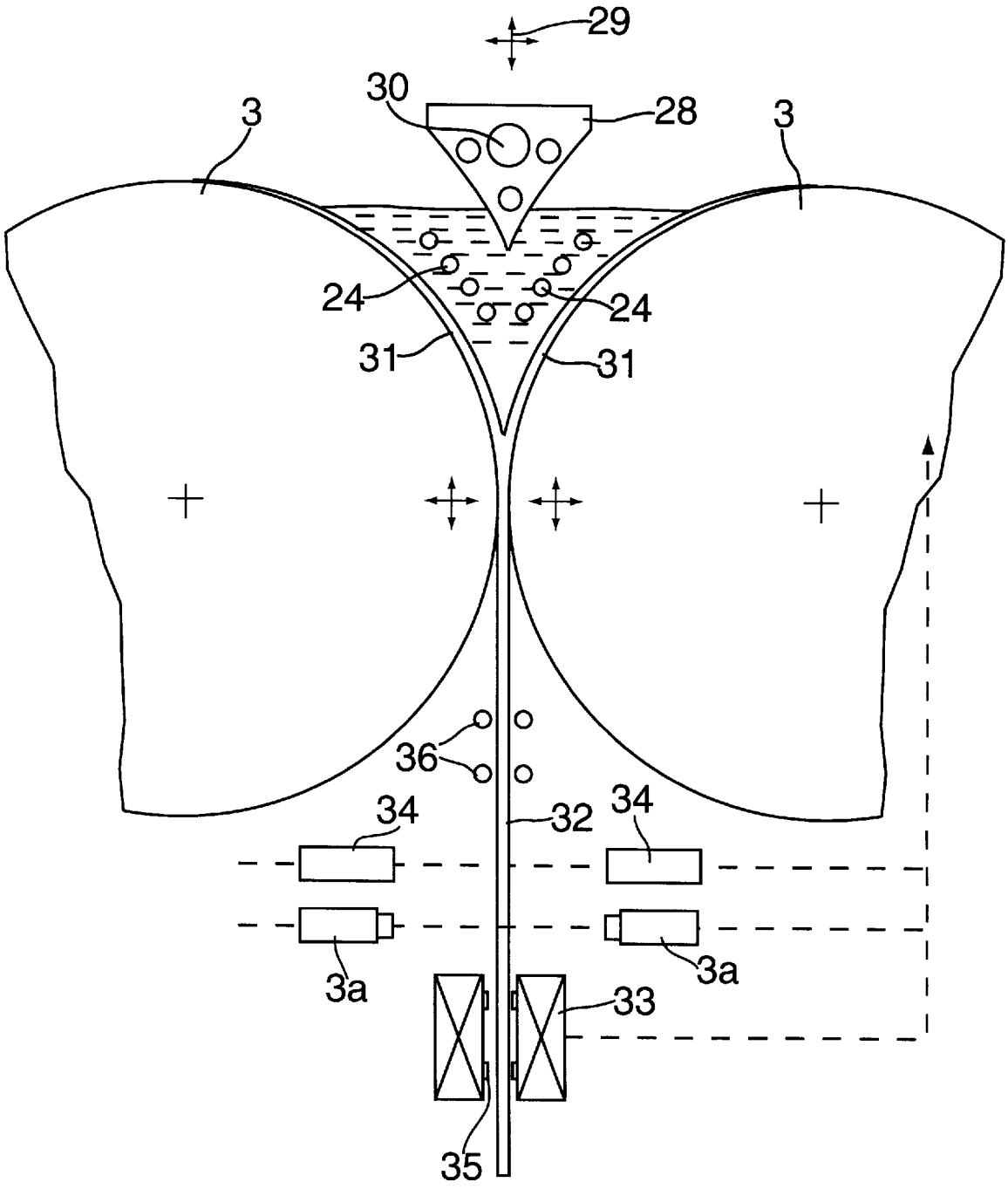
FIG. 7 is an enlarged schematic view of the casting roll mechanism.

A continuous variable casting system with an automatic control is shown in FIGS. 5, 6 and 7. The casting system is capable of forming extremely thin hot-roll ed strips of steel, of varying alloys and grades. The automated control of the system utilizes a central control unit 11, 12 and a plurality of local control units 14, 15, 16, 17, 18, which are interconnected via a bus interface. The central control unit 11, 12 utilizes an empirical data matrix and a neural network based fuzzy logic system, and provides control parameters for all system functions based on sensor data (provided by the local control units 14, 15, 16, 17, 18). The neuro-fuzzy system used by the central control unit 11, 12 can utilize if-then rules or other conventional differentiation methods. The central control unit 11, 12 generally provides an inexpensive and quick adjustment of system parameters to enable changes in output profile without significant delay.

A liquid-type metal can be poured or discharged from a tundish or fore-hearth 1 into an inlet mold 2. The regulation of the flow of the liquid-type metal is controlled from the central control unit 11, 12 using various flow control mechanisms such as a slide valve in the pouring spout or channel. A hot molten metal accumulates and is maintained at proper levels in a pool in the inlet mold 2 on the top side of the crevice formed by a proximity of casting rolls 3. The inlet mold 2 may also consist of a distributor trough or other molten metal pooling devices. The level of the pool may be monitored by a radiometric measurement device, an optical measurement device or a float measurement device. The measurements provided by any of these devices are fed back to the central control unit 11, 12 through the local casting sensor control unit 14, from which varying control of the tundish or fore-hearth 1 can be administered. The molten metal pool may also be monitored via temperature measurement devices 24 (shown in FIG. 6). Such temperature measurement devices 24 may utilize a plurality of tube clad thermocouples or ultrasonic oscillators to determine the temperature gradient of the molten pool. An initial cooling mechanism 28 (shown in FIG. 7) may be fixed centrally within the molten pool to cool the metal to a temperature at which solid formation may begin. The initial cooling mechanism 28 is hollow and has continuous orifices 30 extending laterally. A coolant may be pumped through these continuous orifices 30 at a predetermined rate as controlled by the central control unit 11, 12 through the local casting sensor control unit 14. The rate of the coolant flow depends on the measurements taken by the temperature measurement devices 24. Consistent pool temperatures may also be obtained by a circulation of the molten metal in the pool by a stirring devices, i.e., an electronic coil. A precise control of the temperature gradients throughout the pool properly cools the molten metal at the casting rolls 3 to enable a formation of solidification shells 31.

The casting rolls 3 provide a primary control for setting the thickness of the metal to be formed. The casting rolls 3 are preferably surfaced with a structural pattern (e.g., a zig-zag, a fishbone design etc.). The casting rolls 3 have an axial freedom of motion as indicated by directional arrows 29. A substantially precise control of the distance between centers of the two casting rolls 3 allows extremely thin (e.g., as small as 1 mm) strips to be formed. The position of the casting rolls can be constantly monitored by one or more lasers 19, with precise location data being fed back to the central control unit 11, 12. Several mechanisms for maintaining proper formation of the solidifying metal are provided adjacent to casting rolls 3. A rectangular form of the required output strip 32 is obtained by casting space side borders 23, a height and position adjusting equipment 27, an electric arrangement 21 for correctional form, and roll form, and other form influencing devices 26 (e.g., an induced hydraulic adjustment cylinders, etc.). The casting rolls 3 also have edge heating devices 22 to ensure that a proper crowned edge can be formed on the output strip 32.

The casting rolls 3 rotate at a particular rate of speed M, and a rate of torque n that is controlled by the central control unit 11, 12 via the local casting sensor control unit 14. These rates M, n, combined with the regulation of the temperature of the molten metal pool in the inlet mold 2, may generally affect the formation of the solidification shell 31. By maintaining cool outer skin temperatures on the solidification shells 31, a prompt separation of the strip of steel from the casting rolls 3 occurs. The maintenance of the proper outer skin temperature on the solidification shell 31 may be further enhanced by selectively cooling the casting rolls 3 by a coolant flowing through orifices 20 which extends laterally through the casting rolls 3. A vibratory pumping of the coolant through the casting roll orifices 20 (which is controlled by the central control unit 11, 12 via the local casting sensor control unit 14) makes the separation between the casting rolls 3 and the solidification shells 31 easier. The control of this cooling procedure provides three separate zones of cooling: two edge zones I, III, and a central zone II. The cooling of the casting rolls 3 by this procedure may be accomplished independently for each casting roll 3. With proper cooling settings, the metal strip 32 is tangentially formed with respect to the casting rolls 3. The strip 32 passes through a vibration mechanism 36, which further ensures a proper separation of the solidification shells 31 from the casting rolls 3. A plurality of vibration sensors can be utilized to provide a complete control of the vibration mechanism 36 via the central control unit 11, 12 and the local casting sensor control unit 14.

After the metal strip 32 passes through the vibration mechanism 36, this strip 32 is monitored for its temperature and profile. Temperature distribution sensors 3a monitor the skin temperature of the metal strip 32. The temperature is fed back to the central control unit 11, 12 through the local casting sensor control unit 14, and then utilized to further adjust the cooling parameters applied at the inlet mold 2 and the casting rolls 3. The metal strip 32 is further measured by using a profile measurement device 34. The strip profile and thickness measurements can be taken by a plurality of sensors (e.g., laser measurement devices). The values thus obtained can be fed back to the central control unit 11, 12 via the local casting sensor control unit 14 to be used for varying any of the parameters (e.g., spacing of the casting rolls 3, a molten metal temperature profile, etc.). Position sensors 35 can be utilized in conjunction with an electromagnetic tension and guidance control arrangement 33 to provide a consistent feed of the metal strip 32 into the remainder of the system. As the metal strip 32 moves forward past the casting rolls 3 and various sensors, it is placed into a horizontal position and prepared for the forming rolls 7. An electronic inductive and vibration control equipment arrangement 4 is utilized to maintain the strip moving along the desired cornering path, preferably free of defects that may be caused by any conventional device which is used to provide guidance and physical contact with the metal strip 32.

Prior to entering forming rolls 7, a plurality of line or plate inductors 5 are provided to establish a uniformity in the temperature of the strip and to maintain a desired initial temperature. The inductors are controlled by the central control unit 11, 12 via the local casting sensor control unit 14. As the metal strip 32 continues to extend, an image and pattern recognition unit 6 may be utilized to determine whether any cracks in the surface of the strip have formed. For example, infrared cameras may be used as the image and pattern recognition unit 6. The information generated by this image and pattern recognition unit 6 may be provided to the central control unit 11, 12 via the local image sensor control unit 15. In response, the central control unit 11, 12 may adjust the parameters of the casting temperature or apply different parameters to the line or plate inductors 5. The metal strip 32 may also pass through a descaling portion 7*a*, where a water spray applied thereon. Thereafter (i.e., after the descaling phase), the profile of the metal strip 32 can be checked before the metal strip 32 enters into the first forming roll 7. A strip profile and measurement device 7*b* (which is similar to the profiling equipment 34 used as the metal strip 32 is discharged from the casting rolls 3) can also be utilized. The obtained measurements can be fed to the central control unit 11, 12 via the local reel control unity 18, and they can be utilized to vary the rate of speed M' and rate of torque n', which are applied to a reel 9.

The metal strip 32 may pass through more than one forming roll 7. These forming rolls 7 may consist of two-high or four-high roll stands, which have a minimum roll gap adjustment and may include a roll bending device. In addition, the metal strip 32 does not have to pass through any forming rolls 7. The forming rolls 7 are controlled by the central control unit 11, 12 via the local forming roll control unit 16. At the discharge of the forming rolls 7, an output strip profile and measurement device 7*c* is utilized to verify that the strip and edge profiles of the strip 32 are properly formed. A feedback to the central control unit 11, 12 is provided through the local reel control unity 18. Then, the metal strip 32 passes through a heat treatment arrangement 8, which may include inductive heating elements or cooling elements for providing a temperature profile which depends on the grade and alloy of steel to be rolled. The heat treatment is controlled from the central control unit 11, 12 via the local heat treatment control unit 17. At the output of the heat treatment arrangement 8, the metal strip 32 may be rolled in a reel 9 at a rate of speed M' and a rate of torque n'. The reel 9 is controlled by the central control unit 11, 12 via the local reel control unit 18.

The reel 9 (e.g., a finished reel) of the hot-rolled steel may be transferred to a cold-rolling stand 10, where a cold rolling of the steel may occur (via a direction of the central control 11, 12 through an interface 13).

We claim:

1. A continuous casting and rolling system for steel strips, comprising:

a vertically working two-roll casting device;

a first device for adding molten steel to the casting device;

a second device for guiding a cast strip produced by the casting device into a horizontal position;

a horizontally working rolling mill for working the cast strip;

a reel device receiving the strip worked in the horizontally working rolling mill, each of the casting device, the first device, the second device, the horizontally working rolling mill and the reel device being controlled by respective individual closed-loop control systems; and a central control system connected to the first device, the casting device, the second device, the rolling mill and the reel device for an integrated adjustment of the respective individual closed-loop control systems as a function of mathematical models, wherein each of the first device, the casting device, the second device, the rolling mill and the reel device is an individual component of the continuous casting and rolling system, and wherein the central control system automatically controls the individual components with respect to their interaction to produce a strip which is suitable for further processing to allow for an effects control procedure of one of the individual components on downstream devices of the system.

2. The continuous casting and rolling system of claim 1, wherein the central control system optimizes the behavior of and coordinates the individual components, and control system comprises a neuro-fuzzy control system.

3. The continuous casting and rolling system of claim 1, wherein the central control system generates a matrix of empirical values used for control and regulation.

4. The continuous casting and rolling system of claim 2, wherein an optimization includes a simulation of a behavior under different input conditions.

5. The continuous casting and rolling system of claim 2, wherein casting roll positions and positions of related elements are regulated by actuators with absolute position sensors, wherein the central control system provides values for an absolute position regulator and makes corrections on the strip as a function of the results.

6. The continuous casting and rolling system of claim 5, wherein correction values for control purposes are obtained from a matrix of empirical values, and wherein the neuro-fuzzy system establishes a logic operation and mutual influence.

7. The continuous casting and rolling system of claim 1, wherein a main control parameter of the casting rolls of the casting device is the position of a zone where shells of the strip that are formed are combined, and wherein the position of the zone is determined by an instantaneous conversion force requirement of the casting rolls.

8. The continuous casting and rolling system of claim 1, further comprising:

an electromagnetic arrangement for at least one of a longitudinal and transverse movement and a guidance of the strip in an area downstream from the casting device.

9. The continuous casting and rolling system of claim 2, further comprising a strip forming mold upstream from the casting device so that the casting rolls of the casting device function essentially as forming rolls.

10. The continuous casting and rolling system of claim 9, wherein the neuro-fuzzy control system and the matrix of empirical values also take into account the strip forming mold and its behavior.

11. The continuous casting and rolling system of claim 1, wherein the strip complies with the tolerances of the downstream devices for the further processing while the strip adjusts the individual closed-loop control systems to one another.

12. The continuous casting and rolling system of claim 11, wherein the further processing is performed by a cold rolling mill.

13. The continuous casting and rolling system of claim 3, wherein the matrix of empirical values is used for a preliminary control of the individual components.

14. The continuous casting and rolling system of claim 4, wherein the different input conditions include critical conditions.

15. The continuous casting and rolling system of claim 6, wherein the neuro-fuzzy system utilizes a time response of correction effects.

* * * * *